US006499951B2

(12) United States Patent
Pan et al.

(10) Patent No.: US 6,499,951 B2
(45) Date of Patent: Dec. 31, 2002

(54) FAN HEAD SWINGING DEVICE

(76) Inventors: Huang Chuan Pan, 9F 3R, No.210, Chung Hsueh Rd., Tainan City (TW); Huang Chen Lung, 9F 3R, No.210, Chung Hsueh Rd., Tainan City (TW)

( * ) Notice: Subject to any disclaimer, the term of this patent is extended or adjusted under 35 U.S.C. 154(b) by 0 days.

(21) Appl. No.: 09/873,586

(22) Filed: Jun. 1, 2001

(65) Prior Publication Data

US 2002/0182075 A1 Dec. 5, 2002

(51) Int. Cl.[7] ..... F04D 25/10
(52) U.S. Cl. ..... 416/100; 416/172; 416/170 R
(58) Field of Search ..... 415/122.1, 124.1, 415/126, 127; 416/170 R, 172, 100

(56) References Cited

U.S. PATENT DOCUMENTS 4,832,576 A * 5/1989 Deguchi et al. ..... 417/45
5,720,594 A * 2/1998 Snow ..... 416/100
5,800,126 A * 9/1998 Tsai ..... 416/100
6,015,262 A * 1/2000 Huang ..... 416/100
6,272,874 B1 * 8/2001 Keeney ..... 62/240

FOREIGN PATENT DOCUMENTS

JP 62013797 A * 1/1987

* cited by examiner

*Primary Examiner*—Edward K. Look
*Assistant Examiner*—Ninh Nguyen

(57) ABSTRACT

A fan head-swinging device includes a speed reducer and a DC motor. The speed reducer consists of plural gears engaging with each other. The DC motor is fixed behind a housing of a fan, having a spindle fixed on with a small gear engaging with one of the plural gears of the speed reducer. So the shaft of that gear may rotate with a very slow speed suitable to the fan head to swing right and left for a proper angle by controlling the DC motor.

2 Claims, 6 Drawing Sheets

FAN HEAD SWINGING DEVICE

BACKGROUND OF THE INVENTION

This invention relates to a fan head swinging device, particularly to one capable to swing right and left for any angle.

A conventional fan head swinging device shown in FIGS. 1 and 2, includes a speed reducer A consisting of plural gears A0 rotated by a synchronous motor B, the motor B has no carbon brushes, and a coil B3 powered to excite magnetism to produce a magnetic field to let the rotor B0 of the motor B to rotate. Then a spindle B1 is connected to the rotor B0, and a gear B2 is fixed on the spindle B1 and engages one of the plural gears A0 of the speed reducer A, causing the head to swing right and left. As the synchronous motor used in the conventional fan has no carbon brushes, which means the excited magnetic field produced between the rotating direction of the rotor B0 and the coil B3 has no constant direction. Therefore, the swinging direction of the fan head cannot be controlled as it should be, and the fan head may be liable to swing reverse if it might receive an exterior force. So an outer wind guider C provided in a cool fan shown in FIG. 3 may change its rotating direction if it is touched. Some traditional fan are provided with a control rod D as shown in FIG. 4 for controlling the fan head in changing its swinging direction, owing to the disadvantage of the synchronous motor in impossibility to control a fan head in swinging correctly.

SUMMARY OF THE INVENTION

The objective of the invention is to offer a fan head swinging device to swing right and left for any angle correctly.

The feature of the invention is a speed reducer connected to a DC motor capable to control in changing the rotating direction of the motor, and subsequently possible to control accurately the swinging angle of a fan head.

BRIEF DESCRIPTION OF DRAWINGS

This invention will be better understood by referring to the accompanying drawings, wherein.

DETAILED DESCRIPTION OF THE PREFERRED EMB0DIMENT

Figure 1:
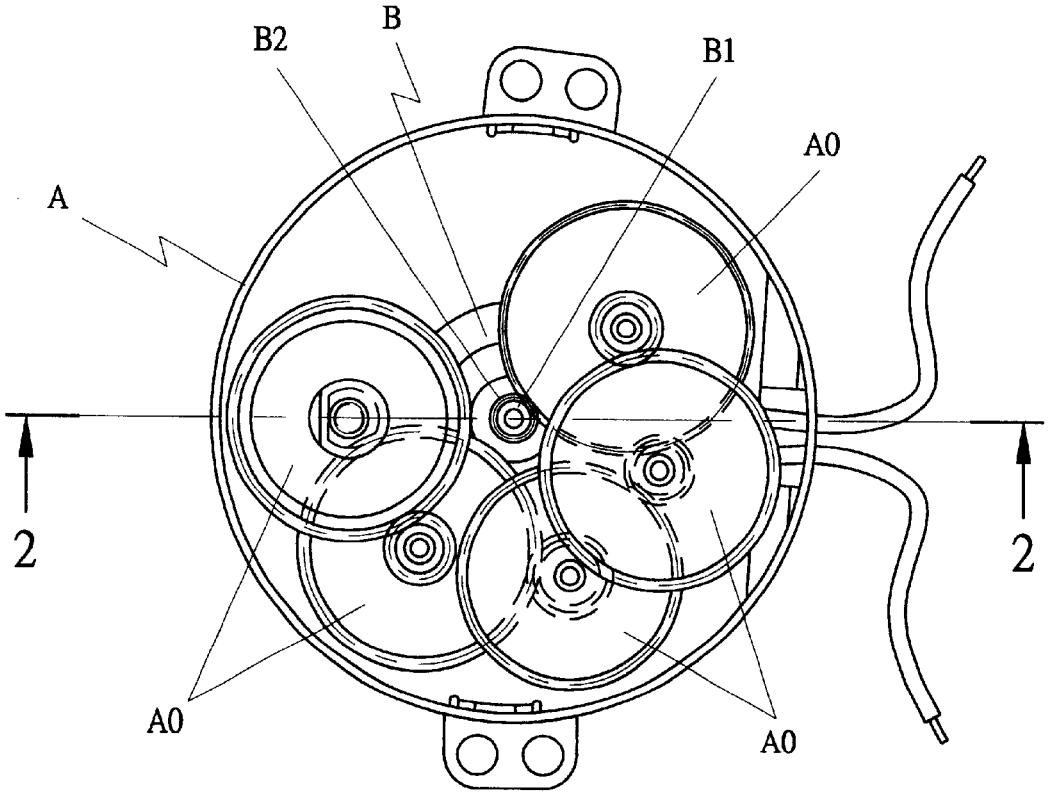
FIG 1 (PRIOR ART)
FIG. 1 is a front view of a speed reducer in a conventional fan.
Figure 2:
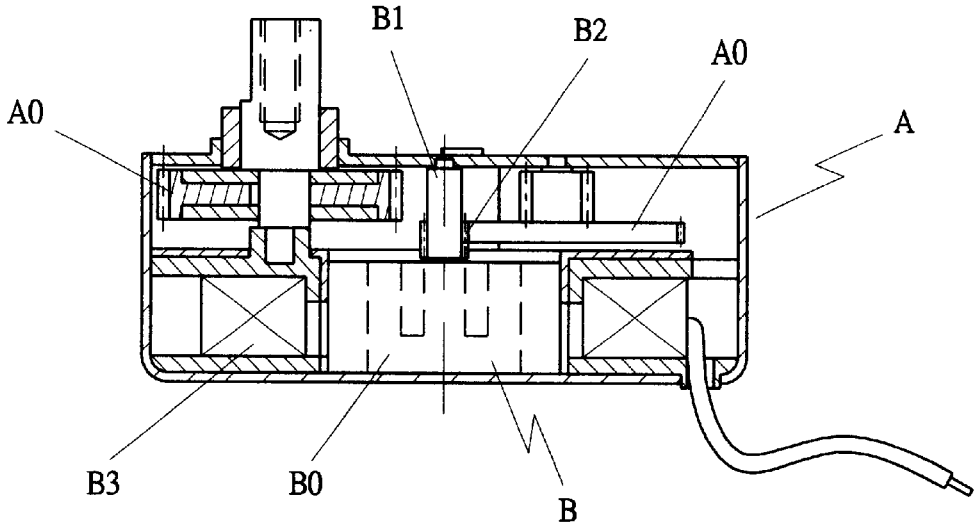
FIG 2 (PRIOR ART)
FIG. 2 is a cross-sectional view of the line 2—2 in FIG. 1.
Figure 3:
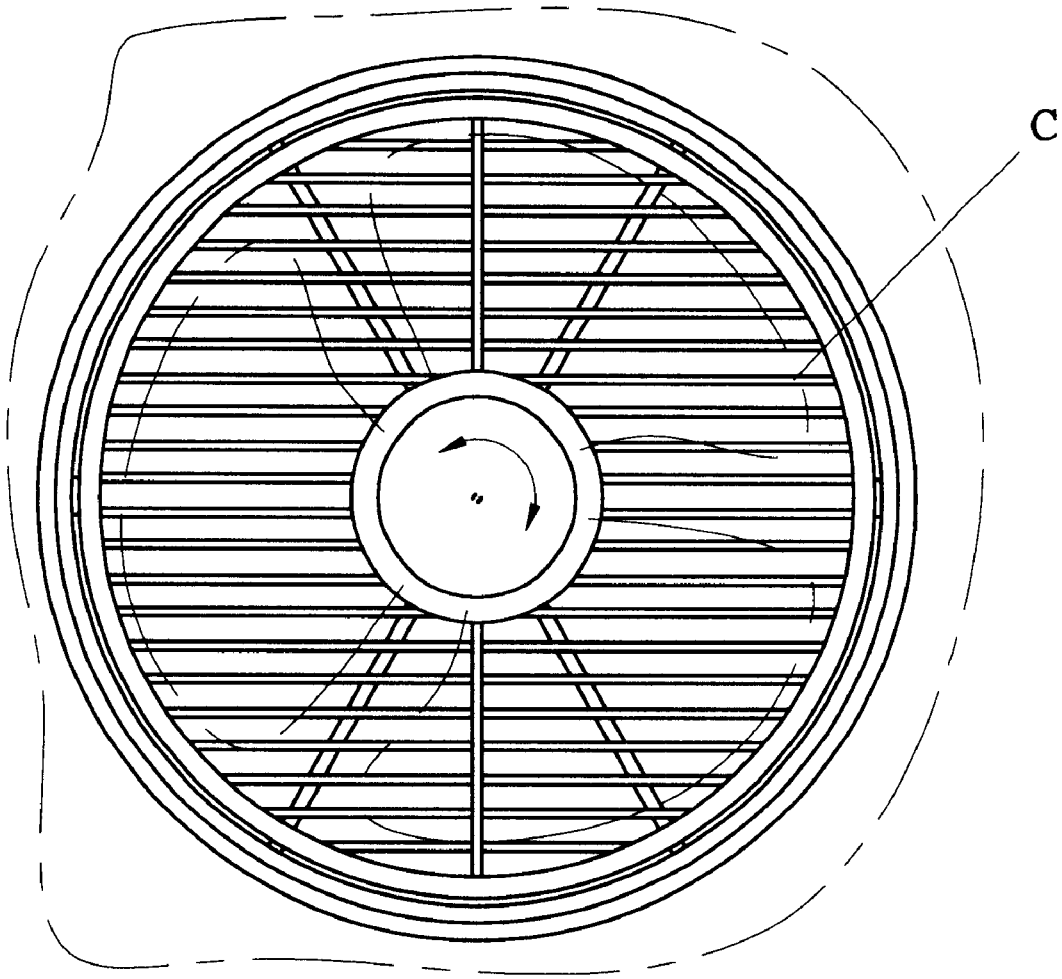
FIG 3 (PRIOR ART)
FIG. 3 is a front view of a conventional cooling fan.
Figure 4:
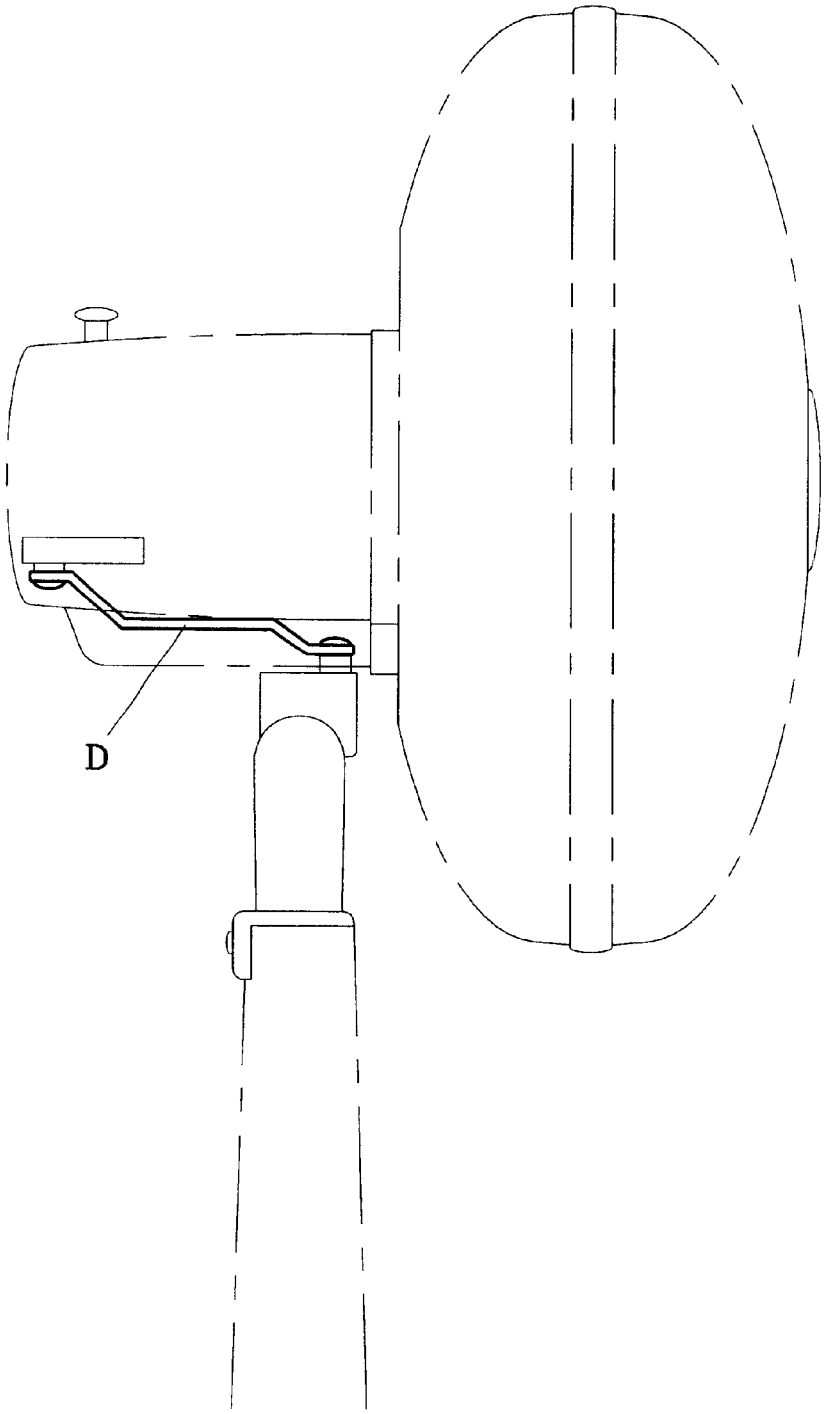
FIG 4 (PRIOR ART)
FIG. 4 is a side view of a conventional fan.
Figure 5:
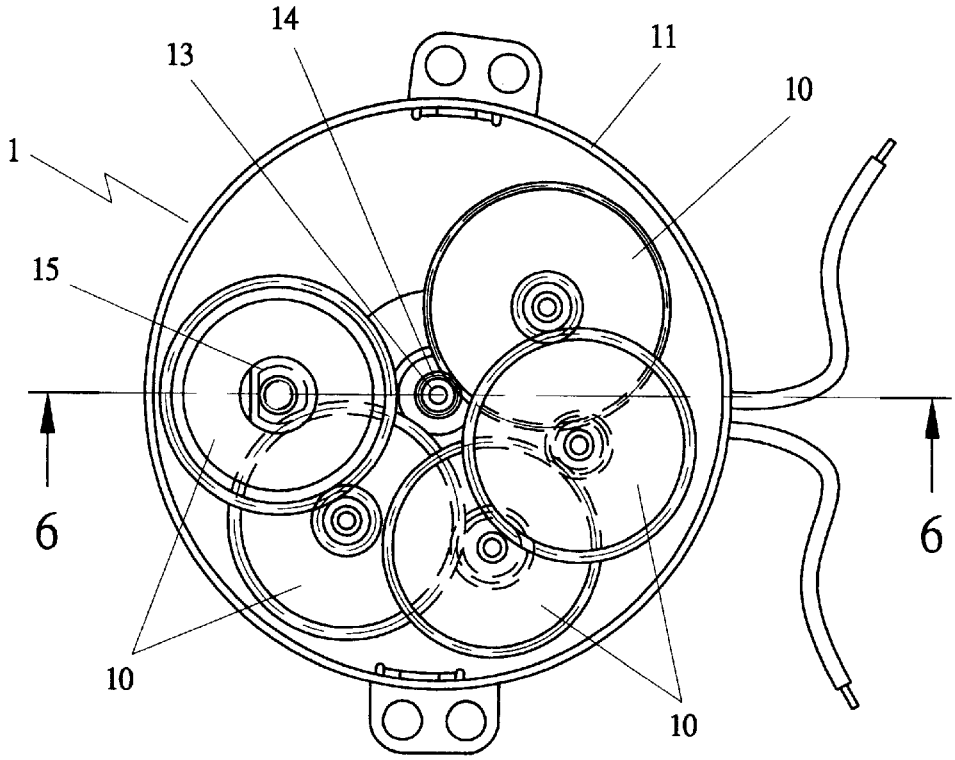
FIG. 5 is a front view of a speed reducer in a fan in the present invention.
Figure 6:
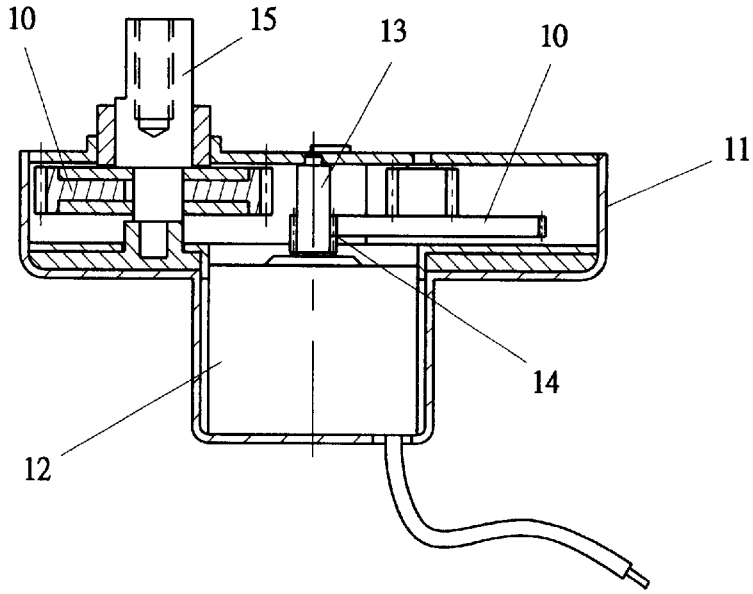
FIG. 6 is a cross-sectional view of the line 6—6 in FIG. 5.
Figure 7:
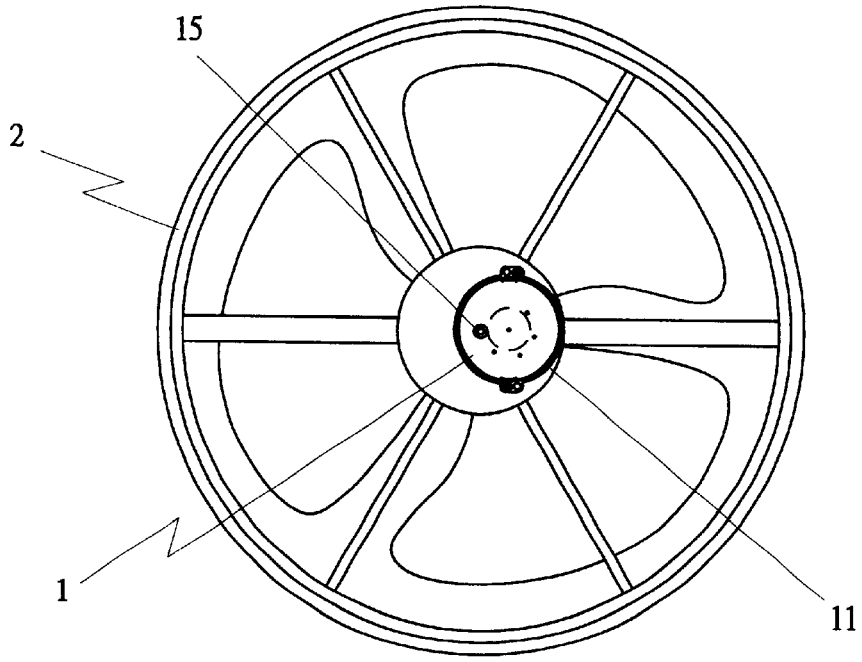
FIG. 7 is a partial view of a cooling fan in the present invention.
Figure 8:
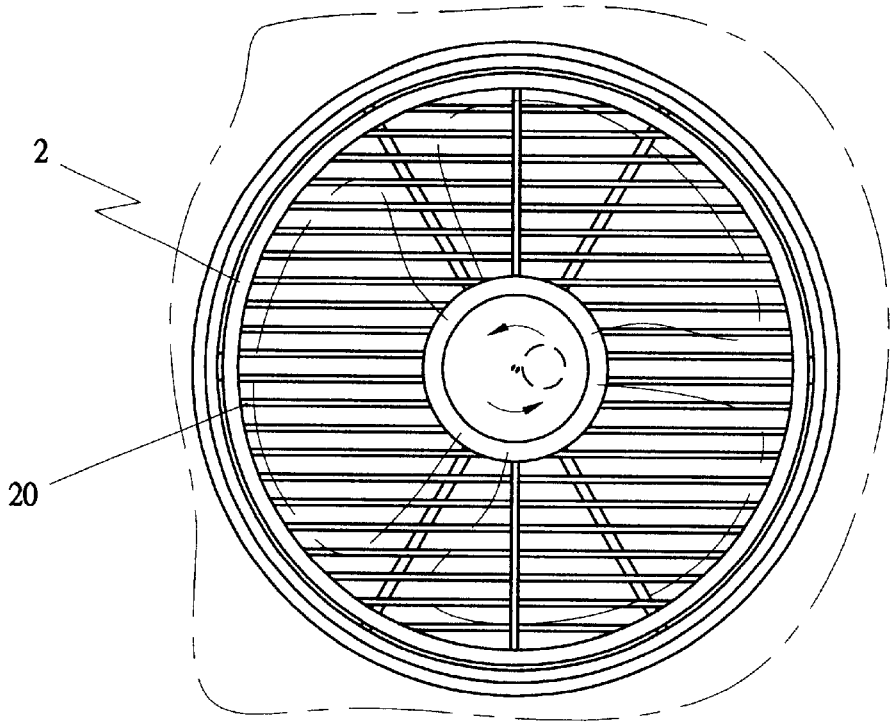
FIG. 8 is a front view of the cooling fan in the present invention.
Figure 9:
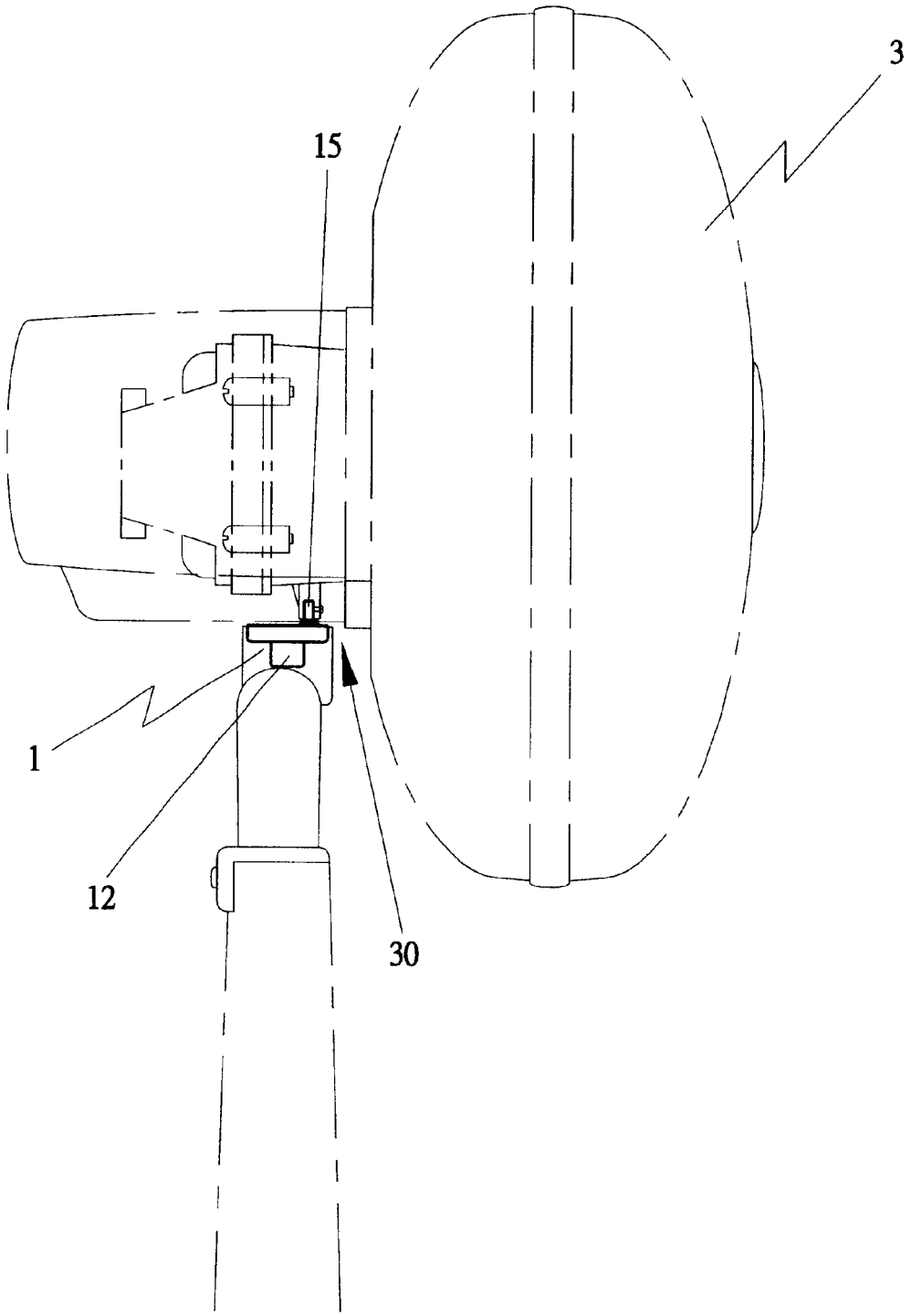
FIG. 9 is side view of the fan in the present invention.

A perferred embodiment of a fan head swinging device in the present invention, as shown in FIGS. 5 and 6, includes a speed reducer 1 consisting of a plurality of gears 10(a first), 11(a second), 12(a third), 13(a fourth) and 14(a fifth) and a small gear 100(a first), 110(a second), 120(a third), 130(a fourth) and 140(a fifth) respectively provided coaxially with the first, the second, the third, the fourth and the fifth gear 10, 11, 12, 13 and 14. The engagement of every two abutting of these five gears is as follows: the first gear 10 is engaged with the second small gear 110 of the second gear 11, the second gear 11 is engaged with the third small gear 120 of the third gear 12 and so forth, thus possible to lower gradually the rotating speed of a DC motor 15 to the minimum. The gear 14 positioned at the rear side of the speed reducer 1 is connected with a shaft 16 fixed with shaft bases 22, 32 in the motor housings 21, 31 of the fan blade 20, 30 at the rear side of a fan 2 or 3. Thus, high rotating speed of the DC motor 15 can be slowed down through reduction in speed of the first, the second, the third, the fourth and the fifth gears 10, 11, 12, 13 and 14 to let the shaft 16 and the fan head swing at a very low speed (1000:3 in most fans on market), accordingly bringing forth a proper amount of wind in the swinging direction of the fan head to let a user feel comfortable.

The DC motor 15 is installed behind the housing 17 of the speed reducer 1 and has a spindle 150 provided with a small gear 151 meshing with the first gear 10 of the speed reducer 1. Thus, after high rotating spped of the DC motor 15 is reduced by the speed reducer 1, the rotating speed of the shaft 16 will be lowered to a very slow one and make the fan head swing at a moderate speed, and besides, the DC motor 15 can be easily controlled to change its rotating direction, therefore the swinging direction of the fan head can be controlled to an angle as needed. In other words, after a user operates the control system, he can set the swinging angle of the fan head as he wants.

The fan head swinging device may be utilized in a cooling fan 2, controlling its wind guider 20 to rotate with a constant speed, and a user can set its rotating direction freely by means of controlling rotating direction of the DC motor 12 only. And the control rod 30 used in the conventional fan can be omitted.

While the preferred embodiment of the invention has been described above, it will be recognized and understood that various modifications may be made therein and the appended claims are intended to cover all such modifications that may fall within the spirit and scope of the invention.

What is claimed is:

1. A fan head swinging device comprising a speed reducer composed of a first, a second, a third, a fourth and a fifth gear, said first, second, third, fourth and fifth gear respectively having a coaxial small gear, each said gear meshing with the coaxial small gear of the abutting of each said gear, a DC motor fixed behind the housing of said speed reducer and having a spindle, said spindle provided with a coaxial small gear meshing with said first gear of said speed reducer, high rotating speed of said DC motor lowered by said speed reducer, the shaft of said fifth gear of said speed reducer actuated to rotate with the slowest speed, said fan head actuated by said shaft of said fifth gear to swing right and left at a moderate speed, the swinging speed of said fan head possible to be controlled to an angle set by a user because the rotating direction of said DC motor can be easily controlled.

2. The fan head swinging device as claimed in claim 1, wherein said five gears of said speed reducer respectively have a coaxial small gear, with said first gear meshing with said coaxial small gear of said second gear, said second gear meshing with said small gear of said third gear and so forth.

* * * * *